US007988334B2

(12) United States Patent
Cheng et al.

(10) Patent No.: US 7,988,334 B2
(45) Date of Patent: Aug. 2, 2011

(54) ILLUMINATING DEVICE WITH ADJUSTABLE ILLUMINATION RANGE

(75) Inventors: Yi-Kai Cheng, Miao-Li Hsien (TW); Jyh-Long Chern, Miao-Li Hsien (TW); Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 235 days.

(21) Appl. No.: 12/274,491

(22) Filed: Nov. 20, 2008

(65) Prior Publication Data

US 2009/0207614 A1 Aug. 20, 2009

(30) Foreign Application Priority Data

Feb. 20, 2008 (CN) ..... 2008 1 0300363

(51) Int. Cl.
*F21S 8/00* (2006.01)

(52) U.S. Cl. ..... 362/268; 362/331; 362/330; 362/336

(58) Field of Classification Search ..... 362/268, 362/331, 330, 606, 607, 244, 246, 224, 333–336, 362/311.02, 311.06, 311.09, 311.1
See application file for complete search history.

(56) References Cited

U.S. PATENT DOCUMENTS

| | | | | |
|---|---|---|---|---|
| 4,739,456 | A * | 4/1988 | Little | 362/268 |
| 6,250,777 | B1 * | 6/2001 | Aoyama | 362/326 |
| 7,159,997 | B2 * | 1/2007 | Reo et al. | 362/240 |
| 7,753,564 | B2 * | 7/2010 | Cheng et al. | 362/311.06 |
| 7,794,117 | B2 * | 9/2010 | Cheng et al. | 362/335 |
| 2003/0076682 | A1 * | 4/2003 | Tanaka et al. | 362/280 |
| 2008/0158873 | A1 * | 7/2008 | Bierhuizen et al. | 362/230 |
| 2008/0158884 | A1 * | 7/2008 | Joergensen et al. | 362/268 |
| 2009/0052182 | A1 * | 2/2009 | Matsuba et al. | 362/268 |

* cited by examiner

*Primary Examiner* — Bao Q Truong
(74) *Attorney, Agent, or Firm* — Clifford O. Chi

(57) ABSTRACT

An illuminating device includes a housing, a light source module, and a plurality of replaceable optical elements. The light source module is positioned in the housing for emitting light having an initial illumination range. The optical elements are configured for respectively converting the initial illumination range into different outputting illumination ranges, each of the optical elements is selectively detachably mountable to the housing for achieving a desired illumination range.

10 Claims, 5 Drawing Sheets

ILLUMINATING DEVICE WITH ADJUSTABLE ILLUMINATION RANGE

BACKGROUND

1. Technical Field

The present invention generally relates to illuminating devices, and particularly to an illuminating device with an adjustable illumination range.

2. Description of Related Art

Light emitting diodes have been widely used in illumination devices to substitute for conventional cold cathode fluorescent lamps (CCFL) due to their high brightness, long lifespan, and wide color gamut. Relevant subject matter is disclosed in an article entitled "Solid State Lighting: Toward Superior Illumination", published in a magazine Proceedings of the IEEE, Vol. 93, No. 10, by Michael S. Shur et al. in October, 2005, the disclosure of which is incorporated herein by reference.

Typical illuminating devices incorporating LEDs generally has a single light field and a stationary color temperature (CCT), which is because the light field, color temperature, and the other characteristics are fixed once the LED is made. Thus, such illuminating device is not suitable for being applied in the particular requirement, such as changeable light field or special CCT effect.

What is needed, therefore, is an improved illuminating device which can overcome the above shortcomings.

SUMMARY

An illuminating device includes a housing, a light source module, and a plurality of replaceable optical elements. The light source module is positioned in the housing for emitting light having an initial illumination range. The optical elements are configured for respectively converting the initial illumination range into different outputting illumination ranges, each of the optical elements is selectively detachably mountable to the housing for achieving a desired illumination range.

Other advantages and novel features will become more apparent from the following detailed description of the present invention, when taken in conjunction with the accompanying drawings.

BRIEF DESCRIPTION OF THE DRAWINGS

Many aspects of the present devices can be better understood with reference to the following drawings. The components in the drawings are not necessarily drawn to scale, the emphasis instead being placed upon clearly illustrating the principles of the present devices. Moreover, in the drawings, like reference numerals designate corresponding parts throughout the several views.

DETAILED DESCRIPTION

Figure 1:
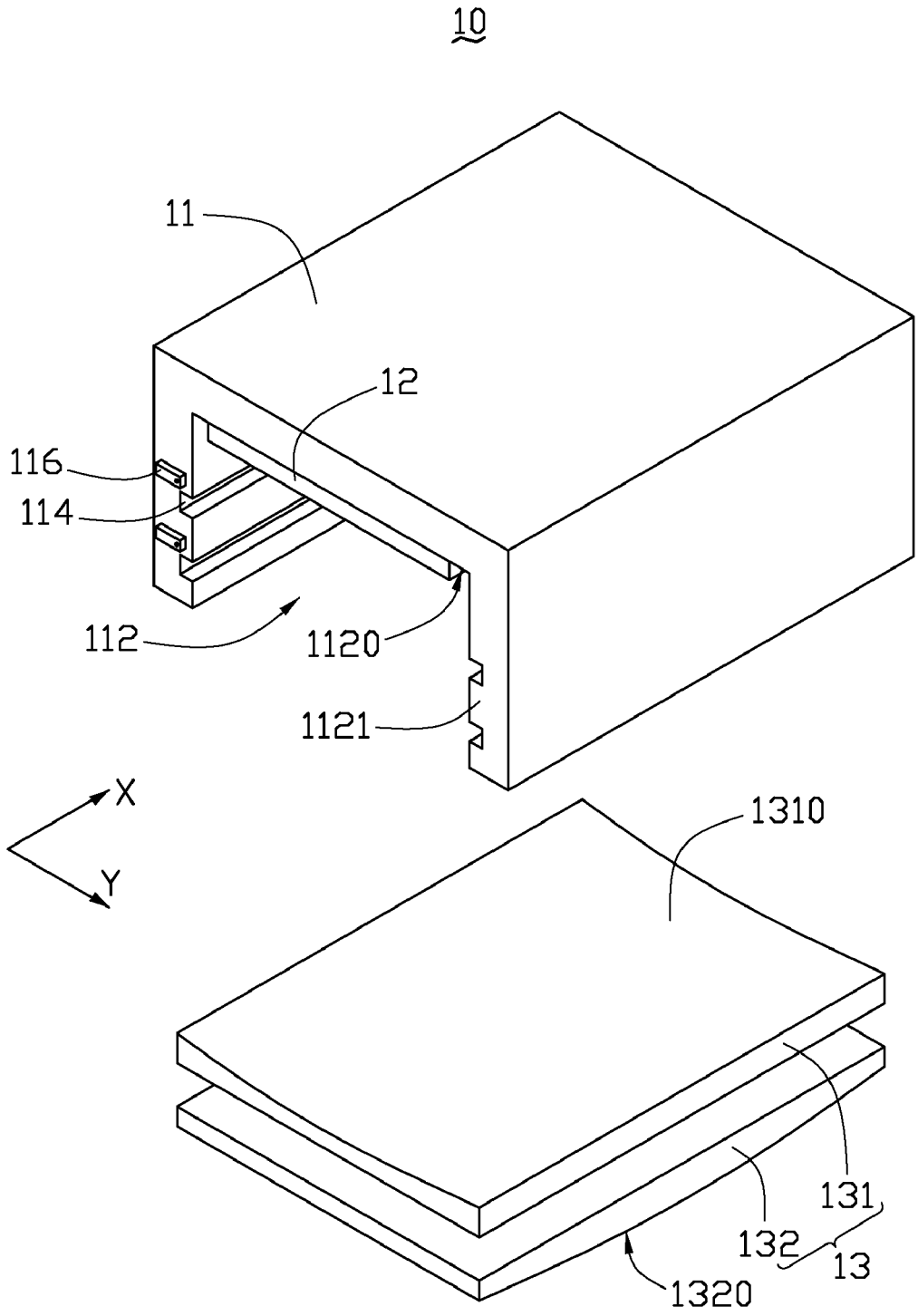
FIG. 1 is a disassembled, schematic view of an illuminating device with a LED module and a lens array according to an exemplary embodiment.

Referring to FIG. 1, an illuminating device 10 in accordance with an exemplary embodiment includes a housing 11, a LED module 12, and an optical module 13.

The housing 11 includes a bottom 1120 and at least two opposite sidewalls 1121 adjacent to the bottom 1120, and a receiving space 112 bounded by the bottom 1120 and the sidewalls 1121. The LED module 12 is received in the housing 11 and positioned on the bottom 1120. A guiding element 114 and a locking element 116 are positioned on the sidewalls 1121. In this exemplary embodiment, the guiding element 114 is a combination of two sliding slots defined in each of the sidewalls 1121 along a direction X parallel to the bottom 1120. The locking element 116 is positioned on one of the sidewalls 1121 adjacent to an inlet of the guiding element 114, one end of the locking element 116 is fixed to the sidewalls 1121, and the other end can be rotated to the inlet of the guiding element 114 for holding the optical module 13 which inserted into the receiving space 112. It can be understood that the guiding element 114 may be a slide rail with balls or rollers.

Figure 2:
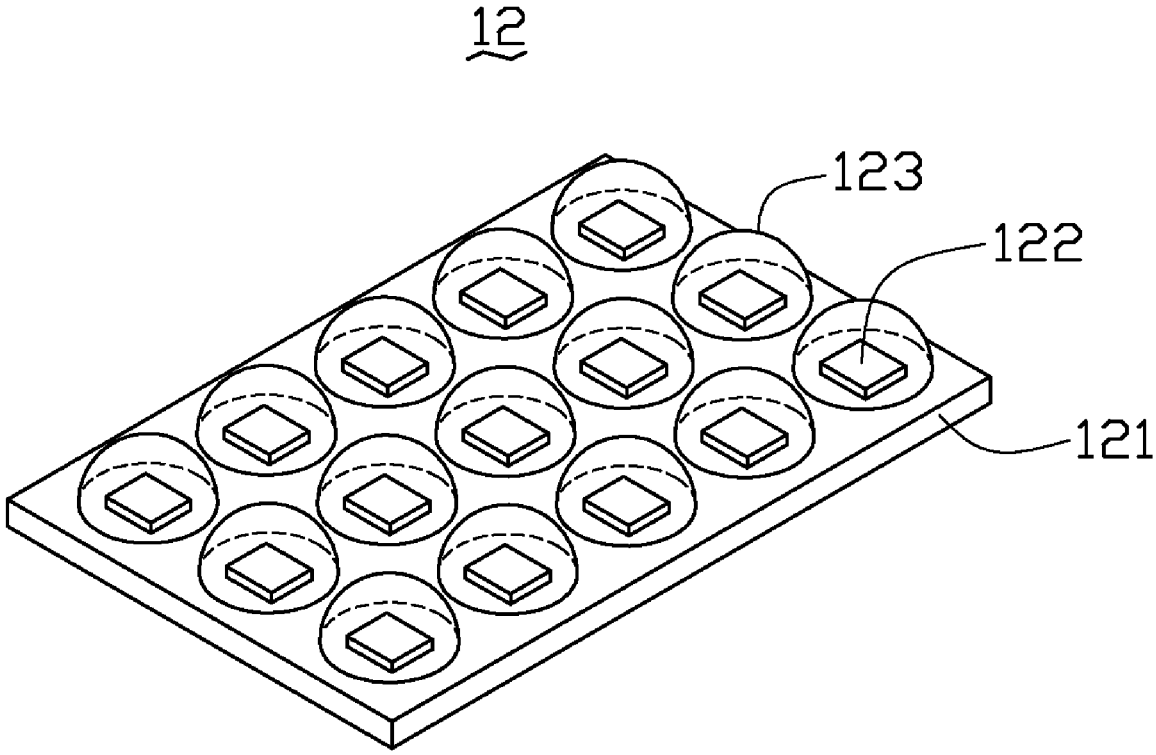
FIG. 2 is a schematic view of the LED module having an encapsulant.
Figure 3:
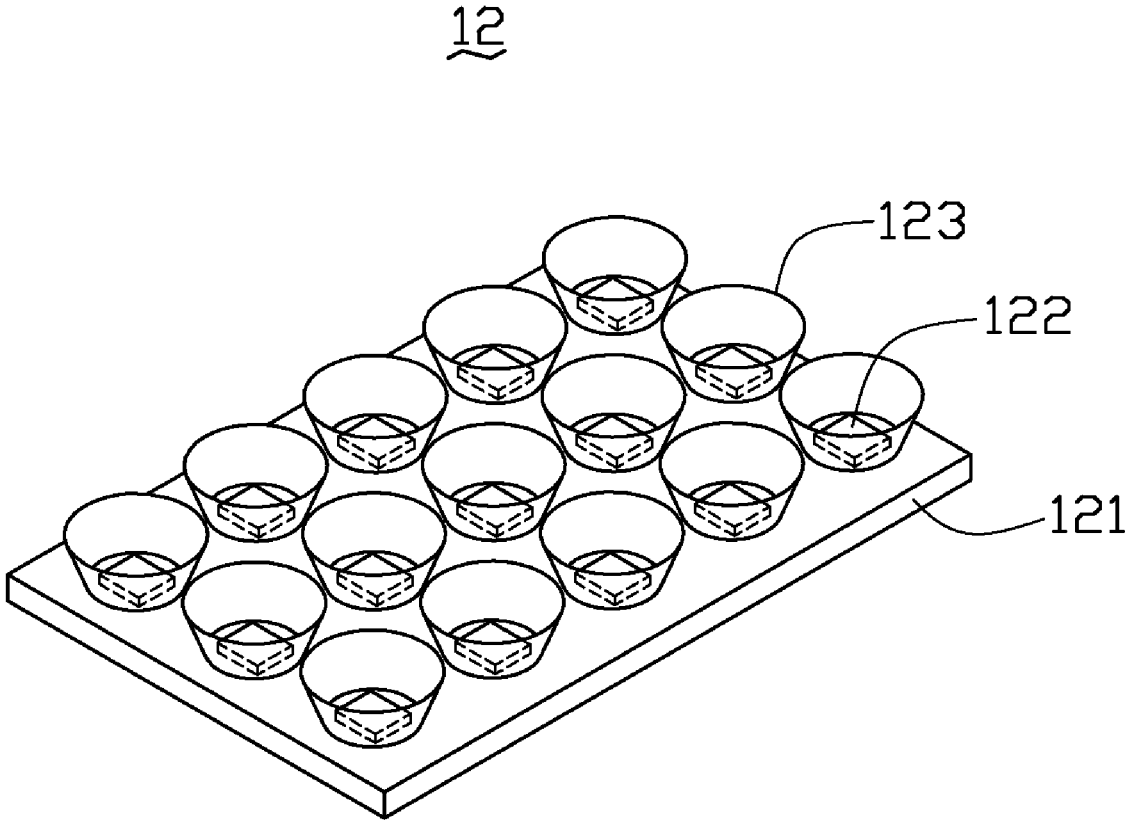
FIG. 3 is a schematic view of the LED module having a reflective cup.

Referring to FIG. 2, the LED module 12 includes a base plate 121, a plurality of LED chips 122 positioned on the base plate 121 and a plurality of first optical elements 123. The base plate 121 is attached to the bottom 1120. The LED module 12 is configured for emitting light having an initial illumination range. The first optical elements 123 are package resin to respectively encapsulate the LED chips 122, to protect the LED chips 122 from mechanical damage, moisture, and atmospheric exposure. It also increases light extraction efficiency of the LED chips 122. Referring to FIG. 3, the first optical elements 123 are reflective cups for collecting light from the corresponding LED chip 122 and redirecting it along a preconcerted direction.

The optical module 13 is configuring for respectively converting the initial illumination range into different outputting illumination ranges, which includes two second optical elements 131, 132. The second optical elements 131, 132 are selectively detachably mountable to the housing 11 for achieving a desired illumination range. Each of the second optical elements 131, 132 is slidably mounted to the housing 11. The second optical elements 131, 132 are engaged to the guiding element 114, that is, they can be inserted into or extracted from the receiving space 112 in an extending direction X of the guiding element 114. When the second optical elements 131, 132 are inserted into the receiving space 112 and being securely supported by the guiding element 114, the second optical elements 131, 132 are paralleled with each other, and the locking element 116 may rotate to lock the second optical elements 131, 132 firmly to avoid movement in the receiving space 112.

In the present embodiment, the second optical element 131 is a light diverging member, such as plano-concave lens, the concave surface 1310 of the plano-concave lens is opposite to the LED module 12. Due to the configuration of the concave surface 1310, the plano-concave lens enables the light passing therethrough to radially deflect from the Y-direction. In other words, the light is deflected from a center towards two sides of the concave surface 1310. As a result, a part of the illumination range along the Y-direction generated by the LED module 12 is expanded after the light passes through the second optical element 131.

In the present embodiment, the second optical element 132 is a light converging member, such as plano-convex lens, the protruding surface 1320 of the plano-convex lens is located away from the optical element 131. Due to the configuration of the protruding surface 1320, the plano-convex lens enables the light passing therethrough to deflect from two sides towards a center of the protruding surface 1320 from the X-direction. As a result, a part of the illumination range along the X-direction generated by the LEDs 84 is compressed after the light passes through the second optical element 132.

It can be understood that, the second optical element 131 may be a convexo-convex lens, and the second optical element 132 may be a concavo-concave lens. In addition, the second optical elements 131, 132 may be Fresnel-lens, so long as a part of the light field generated by the LEDs 84 can be expanded along the Y-direction and be compressed along the X-direction after the light passes therethrough.

Figure 4:
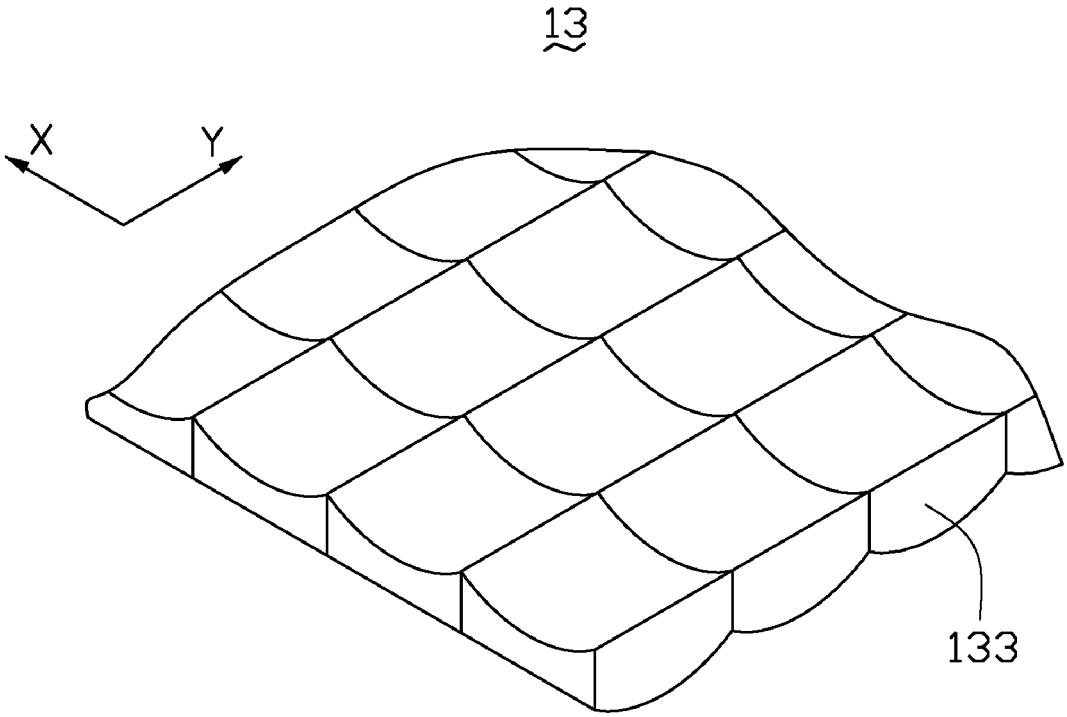
FIG. 4 is a schematic view of the lens array.
Figure 5:
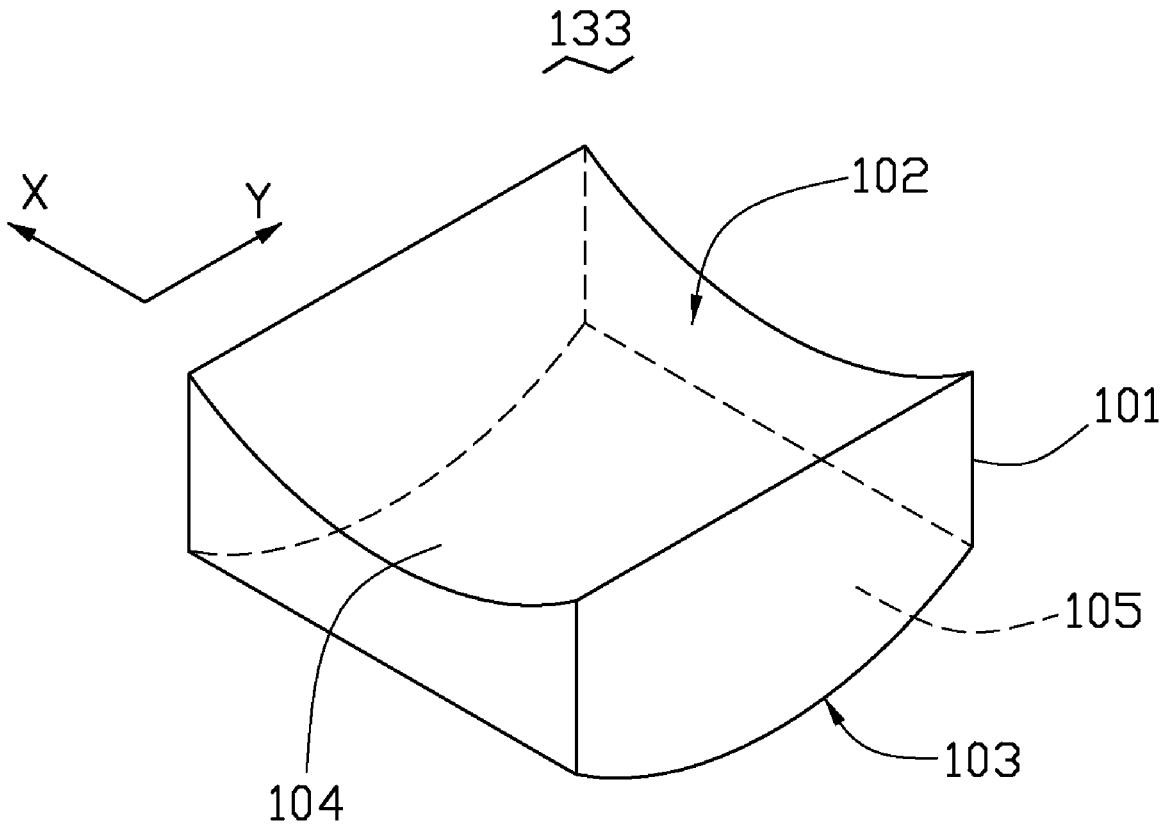
FIG. 5 is a schematic view of a lens element of the lens array.

Referring to FIG. 4, the lens module 13 can also be a lens array, this lens array includes a plurality of lens elements 133 which are respectively corresponding to the LED chips 122. Referring to FIG. 5, each of the lens elements 133 includes a main body 101 which has a light incident surface 102 and a light emitting surface 103 opposite to the light incident surface 102, a light diverging portion 104 for diverging the light emitted from the LED module 12 along an X-direction, and a light converging portion 105 for converging the light emitted from the LED module 12 along a Y-direction. The light emitted from the LED module 12 enters into the lens element 133 from the light incident surface 102, and exits out of the lens element 133 from the light emitting surface 103. The light diverging portion 104 is formed on the light incident surface 102. The light incident surface 102 is a concave curved surface. In the present embodiment, the concave curved surface is a portion of an inner side surface of a cylinder extending along the Y-direction. The light incident surface 102 serves as the light diverging portion 104. The light converging portion 105 is formed on the light emitting surface 103. The light emitting surface 103 has a convex curved surface. In the embodiment, the convex curved surface is a portion of an outer side surface of a cylinder extending along the X-direction. The light emitting surface 103 serves as the light converging portion 105.

The light diverging portion 104 enables the light passing therethrough to radially deflect from the X-direction due to the configuration of the light diverging portion 104. Thus, a part of the light field along the X-direction generated by the LED module 12 is expanded after the light passes through the light diverging portion 104. Contrastively, due to the configuration of the light converging portion 105, the light converging portion 105 enables the light passing therethrough to deflect from two sides towards a center of light emitting surface 103 in the Y-direction. As a result, a part of the light field along the Y-direction generated by the LED module 12 is compressed after the light passes through the light converging portion 105. Therefore, the lens array can be alone placed in the receiving space 112 to change the light field of the LED module 12.

It can be understood that, the lens elements 133 may be integrally formed; the light diverging portion 104 and the light converging portion 105 may be respectively formed on the light emitting surface 103 and the light incident surface 102, to change the light field of the LED module 12; the concave curved surface and the convex curved surface mentioned above may be spherical surfaces, conical surfaces, or the other curved surface with different curvatures; an angle defined between the X-direction and the Y-direction can be an acute angle or a right angle, helps to achieve a desired illumination range of the LED module 12.

The second optical element may be another types which are different from that mentioned above, such as diffusion plate, light guide plate, light wavelength converted plate, filter, polarizer etc. The diffusion plate is configured for diffusing light from the LED module 12. The light guide plate is configured for decreasing light divergence angle of the LED module 12 to improve brightness. The light wavelength converted plate is doped with a plurality of phosphor particles, and the phosphor particles can be excited by blue light from the LED module 12 to emit light with different wavelength. These types of the second optical element can also change the illumination characteristics of the illuminating device 10.

Therefore, the second optical element of the optical module 13 may be a combination of concave lens and convex lens, lens array, diffusion plate, light guide plate, light wavelength converted plate, filter, polarizer etc. At least one of the second optical elements is demountably placed in the receiving space 112 of the housing 11 through the guiding element 114 for changing light field shape of the LED module 12, the light wavelength, brightness, or polarization direction of light from the LED module 12. So, the illumination characteristics of the illuminating device 10 can be changeable by inserting different types of the second optical element into the receiving space 112.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An illuminating device with an adjustable illumination range, comprising:

a housing;

a light source module positioned in the housing for emitting light having an initial illumination range; and a plurality of replaceable optical elements for respectively converting the initial illumination range into different outputting illumination ranges, each of the optical elements being selectively detachably mountable to the housing for achieving a desired illumination range, wherein the optical elements include a lens array comprising a plurality lens elements arranged in an array, each of the lens elements comprising:

a main body which has a light incident surface and an opposite light emitting surface;

a light diverging portion formed on one of the light incident surface and the light emitting surface for diverging the light from the light source module along a first direction; and a light converging portion formed on another one of the light incident surface and the light emitting surface for converging the light from the light source module along a second direction, an angle defined between the first direction and the second direction being an acute angle or a right angle.

2. The illuminating device of claim 1, wherein each of the optical elements is slidably mounted to the housing.

3. The illuminating device of claim 2, wherein the optical elements includes at least one of a light converging member and a light diverging member.

4. The illuminating device of claim 1, wherein the optical elements include a light diffusion plate.

5. The illuminating device of claim 1, wherein the optical elements include a light wavelength converted plate.

6. The illuminating device of claim 1, wherein the optical elements include a Fresnel-lens.

7. The illuminating device of claim 1, wherein the light diverging portion is a concave curved surface extending along the second direction, and the light converging portion is a convex curved surface extending along the first direction.

8. The illuminating device of claim 1, wherein the light source module comprises a base plate and a plurality of LED chips mounted on the base plate, and the LED chips are respectively corresponding to the lens elements.

9. The illuminating device of claim 8, wherein the light source module further comprises a plurality of package resins placed on the base plate to respectively encapsulate the LED chips.

10. The illuminating device of claim 8, wherein the light source module further comprises a plurality of reflective cups placed on the base plate and respectively corresponding to the LED chip.

* * * * *